US008910343B2

(12) United States Patent
Huber et al.

(10) Patent No.: US 8,910,343 B2
(45) Date of Patent: Dec. 16, 2014

(54) STEAM SPONGE

(71) Applicant: Season 4, LLC, Charlotte, NC (US)

(72) Inventors: Eric Wilhelm Huber, San Juan Capistrano, CA (US); Jeremy Losaw, Charlotte, NC (US); Raeshon Lamont McNeil, Charlotte, NC (US); Juan Carlos Perez, Charlotte, NC (US); Thomas James Philpott, Charlotte, NC (US); Daniel Lee Bizzell, Charlotte, NC (US)

(73) Assignee: Season 4, LLC, Charlotte, NC (US)

( * ) Notice: Subject to any disclaimer, the term of this patent is extended or adjusted under 35 U.S.C. 154(b) by 0 days.

(21) Appl. No.: 13/844,784

(22) Filed: Mar. 15, 2013

(65) Prior Publication Data

US 2013/0306103 A1 Nov. 21, 2013

Related U.S. Application Data

(60) Provisional application No. 61/660,724, filed on Jun. 16, 2012, provisional application No. 61/621,507, filed on Apr. 7, 2012.

(51) Int. Cl.

| | |
|---|---|
| ***A47L 7/00*** | (2006.01) |
| ***A47L 13/16*** | (2006.01) |
| ***A47L 11/40*** | (2006.01) |
| ***A47L 13/17*** | (2006.01) |

(52) U.S. Cl.

CPC ..... *A47L 11/4086* (2013.01); *A47L 13/16* (2013.01); *A47L 13/17* (2013.01)

USPC ..... 15/320

(58) Field of Classification Search

USPC ..... 15/104.001, 118, 228, 229.3, 320, 321, 15/322, 302; 38/77.5, 77.7, 77.9

See application file for complete search history.

(56) References Cited

U.S. PATENT DOCUMENTS

| | | | | |
|---|---|---|---|---|
| 3,675,449 | A * | 7/1972 | Bluestein | 68/222 |
| 8,667,637 | B2 * | 3/2014 | Vrdoljak et al. | 15/229.3 |
| 2002/0116784 | A1 * | 8/2002 | Sumner | 15/322 |
| 2007/0079470 | A1 * | 4/2007 | Rippl et al. | 15/320 |
| 2008/0047172 | A1 * | 2/2008 | You | 38/77.5 |

* cited by examiner

*Primary Examiner* — Robert Scruggs

(74) *Attorney, Agent, or Firm* — Tillman Wright, PLLC; Chad D. Tillman

(57) ABSTRACT

The concept is to use a material that is a microwave susceptor as a heat source to provide the energy necessary to instantly turn water into steam. One or more surfaces of susceptor are housed in a steam chamber. When the steam is generated, the pressure built up inside the steam chamber exhausts the steam through an exhaust duct that directs the steam to the cleaning surface. A sponge or other cleaning element is attached to the bottom of the product to allow the user to scrub the cleaning surface.

18 Claims, 13 Drawing Sheets

TOP VIEW

2300

2300

STEAM SPONGE

CROSS-REFERENCE TO RELATED APPLICATION

The present application is a U.S. nonprovisional patent application of, and claims priority under 35 U.S.C. §119(e) to, U.S. provisional patent application Ser. Nos. 61/660,724, filed Jun. 16, 2012, and 61/621,507, filed Apr. 7, 2012, which provisional patent applications are incorporated by reference herein.

COPYRIGHT STATEMENT

All of the material in this patent document, including source code, is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE INVENTION

The present invention relates to a sponge and, more particularly, to a steam sponge.

SUMMARY OF THE INVENTION

The present invention includes many aspects and features. Moreover, while many aspects and features relate to, and are described in, the context of the present disclosure, the present invention is not limited to use only in such context, as will become apparent from the following summaries and detailed descriptions of aspects, features, and one or more embodiments of the present invention.

In an aspect of the invention, a hand operated cleaning apparatus comprises a water vessel or reservoir, a steam chamber, a susceptor, a pump, and a cleaning element. The apparatus is shaped and configured for placement in a microwave. Microwaves heat the susceptor. The pump is configured to spray a mist of water from the reservoir onto the susceptor which, after heating, generates steam within the steam chamber upon contact with the water mist. A duct leads from the steam chamber to the cleaning element for discharge of the steam into the area of the cleaning element. The steam facilitates cleaning using the cleaning element.

In a feature, the cleaning element comprises a sponge.

In a feature, the apparatus further includes a handle that is insensitive to microwaves.

In another feature, the apparatus includes a housing in which the susceptor and the steam chamber are contained.

In addition to the aforementioned aspects and features of the present invention, it should be noted that the present invention further encompasses the various possible combinations and subcombinations of such aspects and features. Thus, for example, any aspect may be combined with an aforementioned feature in accordance with the present invention without requiring any other aspect or feature.

BRIEF DESCRIPTION OF THE DRAWINGS

One or more preferred embodiments of the present invention now will be described in detail with reference to the accompanying drawings.

DETAILED DESCRIPTION

Figure 1:
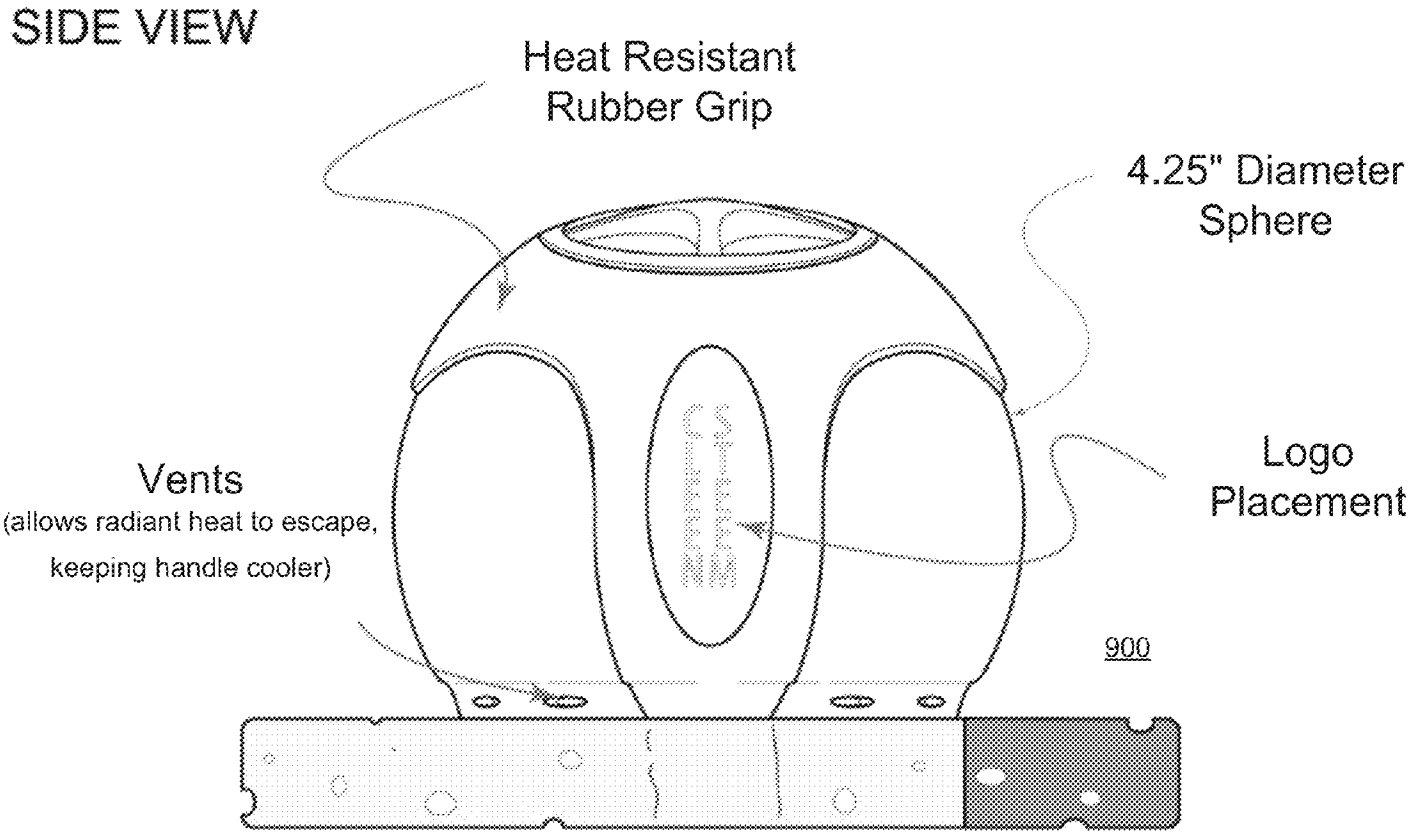
FIG. 1 is a side view of an apparatus 900 representative of a hand operated cleaning apparatus in accordance with an embodiment of the present invention.

As a preliminary matter, it will readily be understood by one having ordinary skill in the relevant art ("Ordinary Artisan") that the present invention has broad utility and application. As should be understood, any embodiment may incorporate only one or a plurality of the above-disclosed aspects of the invention and may further incorporate only one or a plurality of the above-disclosed features. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. As should be understood, any embodiment may incorporate only one or a plurality of the above-disclosed aspects of the invention and may further incorporate only one or a plurality of the above-disclosed features. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Regarding applicability of 35 U.S.C. §112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, one or more preferred embodiments of the present invention are next described. The following description of one or more preferred embodiments is merely exemplary in nature and is in no way intended to limit the invention, its implementations, or uses.

In accordance with embodiments of the invention, the concept is to use a material that is a microwave susceptor as a heat source to provide the energy necessary to instantly turn water into steam. One or more surfaces of susceptor are housed in a steam chamber. When the steam is generated, the pressure built up inside the steam chamber exhausts the steam through an exhaust duct that directs the steam to the cleaning surface. A sponge or other cleaning element is attached to the bottom of the product to allow the user to scrub the cleaning surface. A handle or shell that is made of a material that is insensitive to microwaves is attached to unit to keep the user from contacting the hot surface of the susceptor or the steam chamber. With reference to the drawings of the publication of the present application. i.e., U.S. Patent Application Publication No. 2013/0306103, which publication is incorporated herein by reference, FIG. 1 of 2013/0306103 is a side view of an apparatus 100 representative of a hand operated cleaning apparatus in accordance with an embodiment of the present invention. The apparatus 100 is one of the prototypes that have been made and apparatus 100 includes the general elements comprising a water vessel or reservoir, 102, a steam chamber 104, a susceptor 106, a pump 108, and a cleaning element (not shown) that would be disposed in the cleaning element area 110.

The water vessel is filled with water and closed. The unit is placed in a microwave and set to a power and heating time that is dependent on the final design of the product as well as the power of the microwave. When heating is complete, the unit is removed from the microwave and placed on the cleaning surface. The pump is activated to release a mist of water onto the susceptor or a surface that is heated by the susceptor to create the steam which is ducted to the cleaning surface. The user can continue to activate the pump for further bursts of steam. Once the susceptor has lost enough heat, further pump activations will cease to produce further steam. The unit can then be placed back in the microwave to recharge the susceptor for more steam production if desired. The length of heating time and microwave power settings may be different than those for heating the unit from room temperature.

Variations of the Susceptor

The susceptor can be made of any material that produces heat by absorption of the microwaves produced by a conventional microwave oven. The current prototypes use silicon carbide as the susceptor material but there are other materials that could be suitable, such as aluminum oxide, that have similar microwave absorbing properties. It is unclear what role the binder material or the manufacturing process of the susceptor plays in the microwave absorption properties. Some of the testing has revealed that the susceptor does not need to be in one piece as piles of silicon carbide dust have been observed to heat up in the microwave too.

Figure 2:
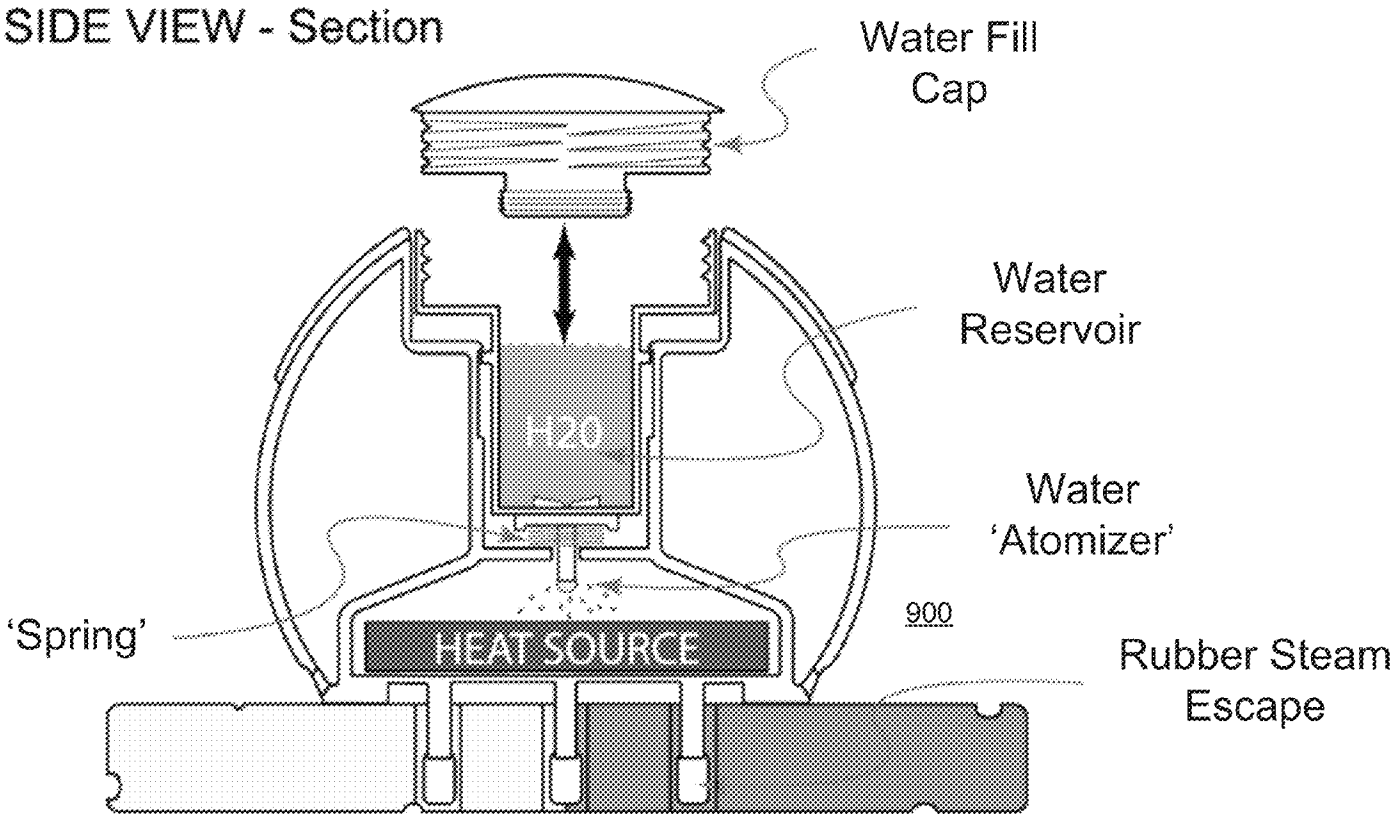
FIG. 2 is another side view of the apparatus 900 of FIG. 1.
Figure 3:
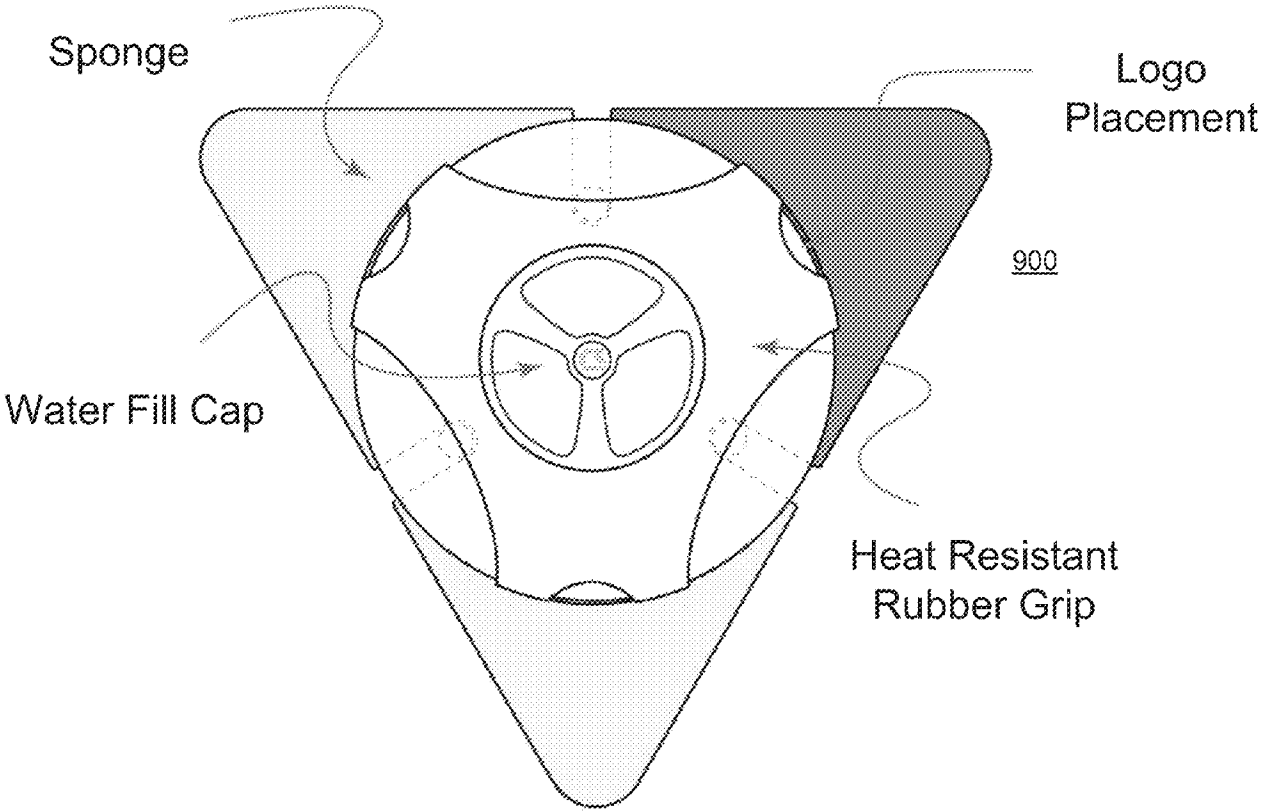
FIG. 3 is a top view of the apparatus 900 of FIG. 1.

The shape of the susceptor is variable depending on the final packaging of the unit. Current prototypes use rectangular blocks that have grooves cut in the surface to increase the surface area for more efficient heat transfer. FIG. 2 of 2013/0306103 shows a bottom of an apparatus 200 similar the apparatus 100, wherein a susceptor is visible. The visible susceptor is exemplary of a shape of a prototype susceptor. It could be feasible that the susceptor is made into a dome shape so that the susceptor material also forms the steam chamber. In this case, and with reference to the graphical illustration of FIG. 3 of 2013/0306103 showing a susceptor being housed inside of an insulating material, the susceptor 304 could be held inside of an insulating material 302 that allows microwaves to pass through it to excite the susceptor but protect the rest of the unit from radiant or conductive heat damage. The insulation material could be a ceramic such as fire brick that is used in pottery kilns.

Figure 4:
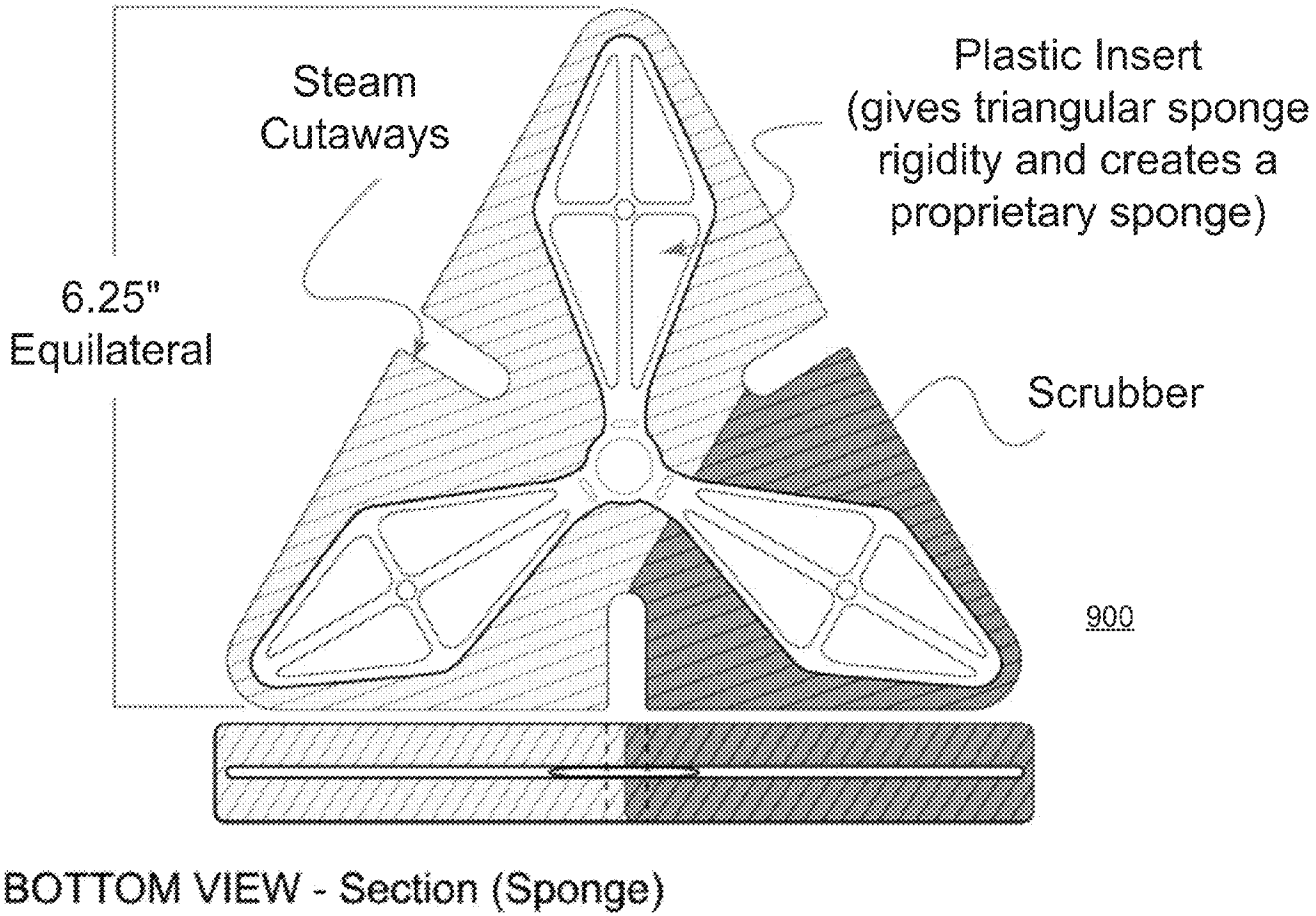
FIG. 4 is a bottom view of the apparatus 900 of FIG. 1.
Figure 5:
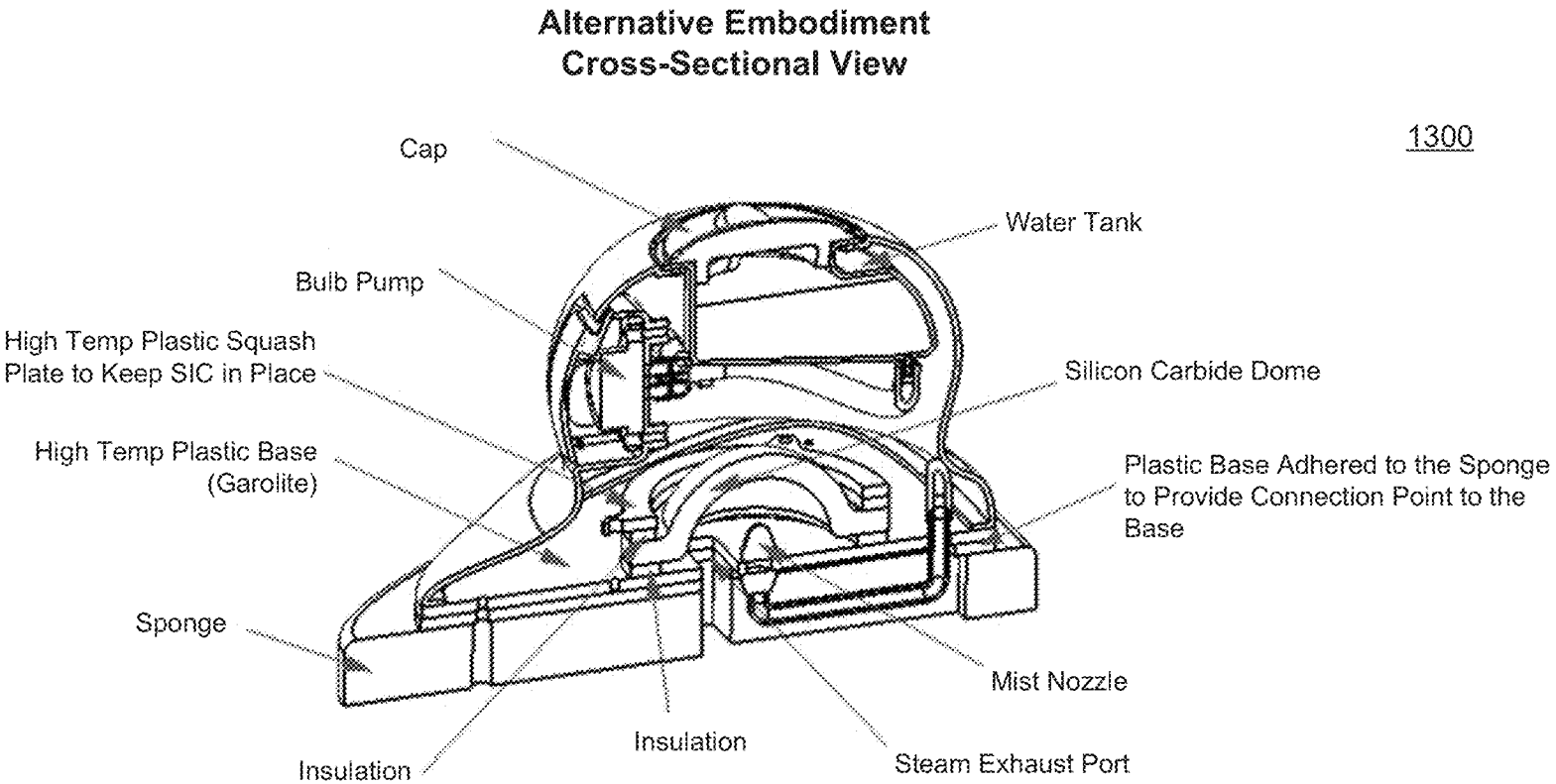
FIG. 5 is a cross-sectional view of another apparatus 1300 representative of a hand operated cleaning apparatus in accordance with an embodiment of the present invention.

The susceptor could also be used to heat another element to boil the water. In this case, there would be a physical connection between the susceptor and the element to allow conduction of heat from the susceptor. The element would get hot enough to boil water, and the pump would direct water onto the surface of the element to make the steam. In this case, the water would not come in contact with the susceptor. An example of a prototype of this system is shown in FIG. 4 of 2013/0306103, wherein a susceptor 404 and a heat sink 406 are adhered together with thermal grease. In particular, this prototype comprises an aluminum heat sink adhered to the susceptor with thermal grease, with the heat sink being placed inside of the steam chamber. During use, the susceptor absorbed the microwaves and got hot, and transferred the heat to the heat sink. The heat sink temperature rose high enough to instantly boil mists of water from the pump. FIG. 5 of 2013/0306103 is a view of a bottom of an apparatus 500 similar the apparatus 200 of FIG. 2 of 2013/0306103, in which the susceptor 404 and heat sink 406 are incorporated Pump and Sprayer The most efficient way to boil the water completely is to decrease the particle size of the water to maximize the surface area of the water droplets. The pump and spay head needs to provide adequate pressure and a flow pattern conducive to water droplet size reduction. However, it needs to be free from materials that are not robust in the microwave. Limited success has been had with prototypes using piston pumps from cleaning products as seen in FIG. 1 of 2013/0306103. The pressure and mist pattern is decent, but they tend to fail after repeated exposure to high temperature water or exposure to microwaves.

Figure 6:
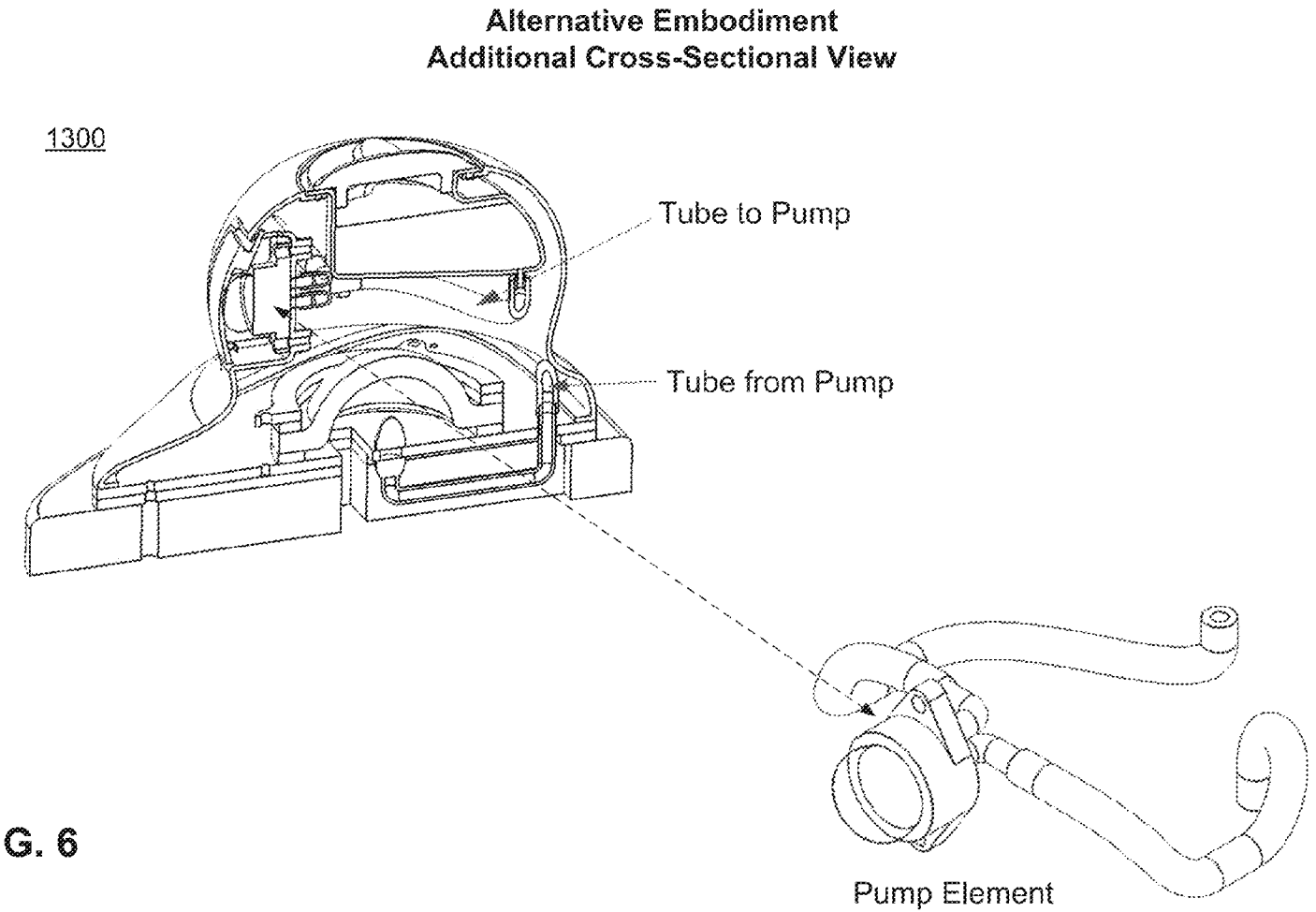
FIG. 6 is another cross-sectional view of the apparatus 1300 of FIG. 5.

An alternative is a bulb style pump like the one show in FIG. 6 of 2013/0306103, which shows a side view of another apparatus 600 representative of a hand operated cleaning apparatus in accordance with an embodiment of the present invention. These are robust in the microwave, however they do not generate sufficient pressure, and they expose the user to too much heat from the hot water being pumped through them. Potential solutions are to add some mechanical advantage to the bulb pump that doubles as heat protection. Another solution is to design a bespoke piston pump with materials that are robust in the microwave and elevated temperatures.

The exit nozzle design needs to particulate the water and distribute it to the heating surface to optimize steam generation. This may be different depending on the geometry of the steam chamber and its elements. It may require a head with multiple exhausts or a mechanism with a spinning head that distributes the water.

User Interface

In the current prototypes, the handle is isolated from the hot water and is made from a plastic that is mostly invisible to microwaves and stays cool to the touch for the user. The user interface could also be in the form of a shell that attaches to the unit yet provides an air gap between the steam chamber and the shell to prevent conductive heating of the shell. FIG. 6 of 2013/0306103 shows an example of the shell setup.

Another way to setup the user interface would be to have it be removable from steam chamber. In this case, the susceptor and steam chamber would go into the microwave for heating. The user interface and pump mechanism would stay outside the microwave during the heating cycle. When the heating cycle is done, the user interface would have a quick connect feature to attach to the steam chamber to retrieve it from the microwave without exposing the user to the heat.

Form and Packaging

Figure 7:
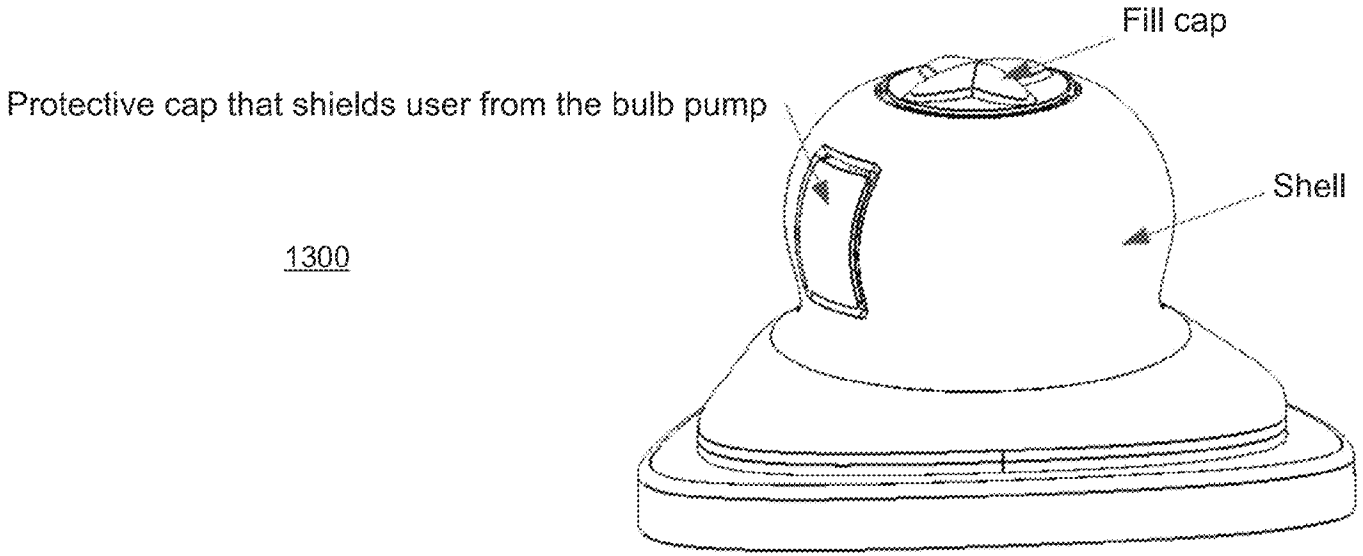
FIG. 7 is a perspective view of the apparatus 1300 of FIG. 5.

Based on the results of the current line of testing, there has been work done on component packaging as well as aesthetic design. FIG. 7 of 2013/0306103, which comprises a graphical illustration of a steam chamber surrounded by a user interface shell so as to define an air gap therebetween, reveals a potential solution for distributing the water to the susceptor as well as paths for the steam to exit from the steam chamber. In this case the pump would be activated by downward pressure provided from the user to inject the water onto the susceptor.

Figure 8:
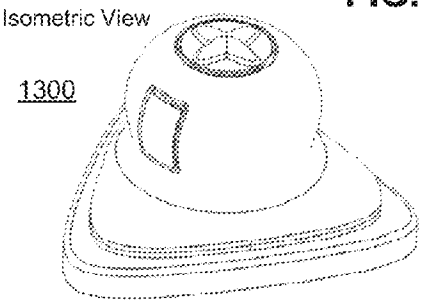
FIG. 8 is an isometric view of the apparatus 1300 of FIG. 5.
Figure 9:
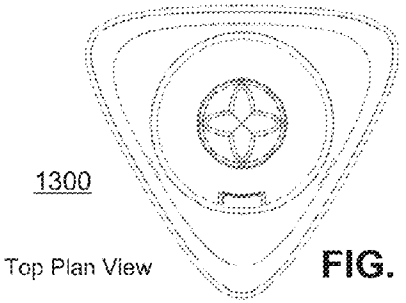
FIG. 9 is a top plan view of the apparatus 1300 of FIG. 5.
Figure 10:
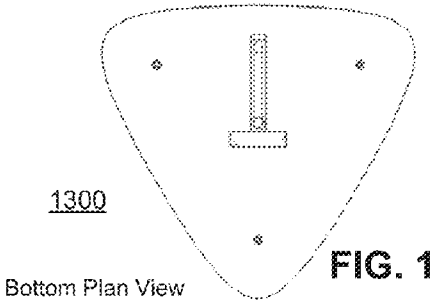
FIG. 10 is a bottom plan view of the apparatus 1300 of FIG. 5.
Figure 11:
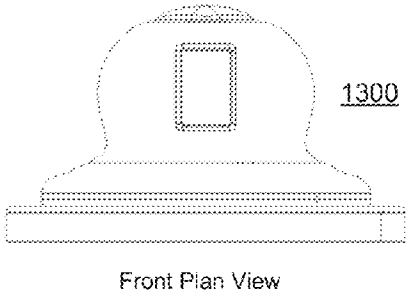
FIG. 11 is a front plan view of the apparatus 1300 of FIG. 5.
Figure 12:
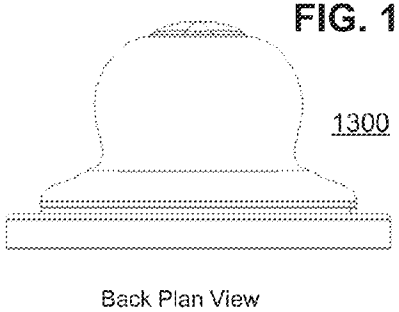
FIG. 12 is a back plan view of the apparatus 1300 of FIG. 5.
Figure 13:
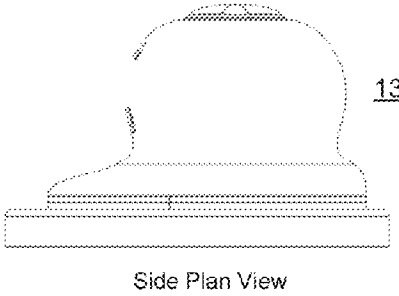
FIG. 13 is a side plan view of the apparatus 1300 of FIG. 5.
Figure 14:
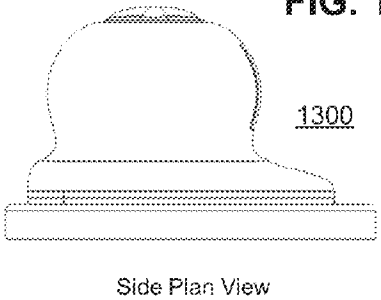
FIG. 14 is another side plan view of the apparatus 1300 of FIG. 5.

FIG. 8 of 2013/0306103 is a perspective view of another apparatus 800 representative of a hand operated cleaning apparatus in accordance with an embodiment of the present invention In particular, FIG. 8 of 2013/0306103 shows a 3D surface model of a proposed aesthetic design for the product. The spherical surface is approximately 2.75 inches in diameter and would house the steam chamber and susceptor. The water would be filled via the cap on the top of the sphere.

FIG. 1 herein is a side view of another apparatus 900 representative of a hand operated cleaning apparatus in accordance with an embodiment of the present invention. Additionally, FIGS. 2-4 further illustrate the apparatus 900 of FIG. 1 herein.

FIG. 5 herein is a cross-sectional view of another apparatus 1300 representative of a hand operated cleaning apparatus in accordance with an embodiment of the present invention. Additionally, FIGS. 6-14 herein further illustrate the apparatus 1300 of FIG. 5 herein.

Figure 15:
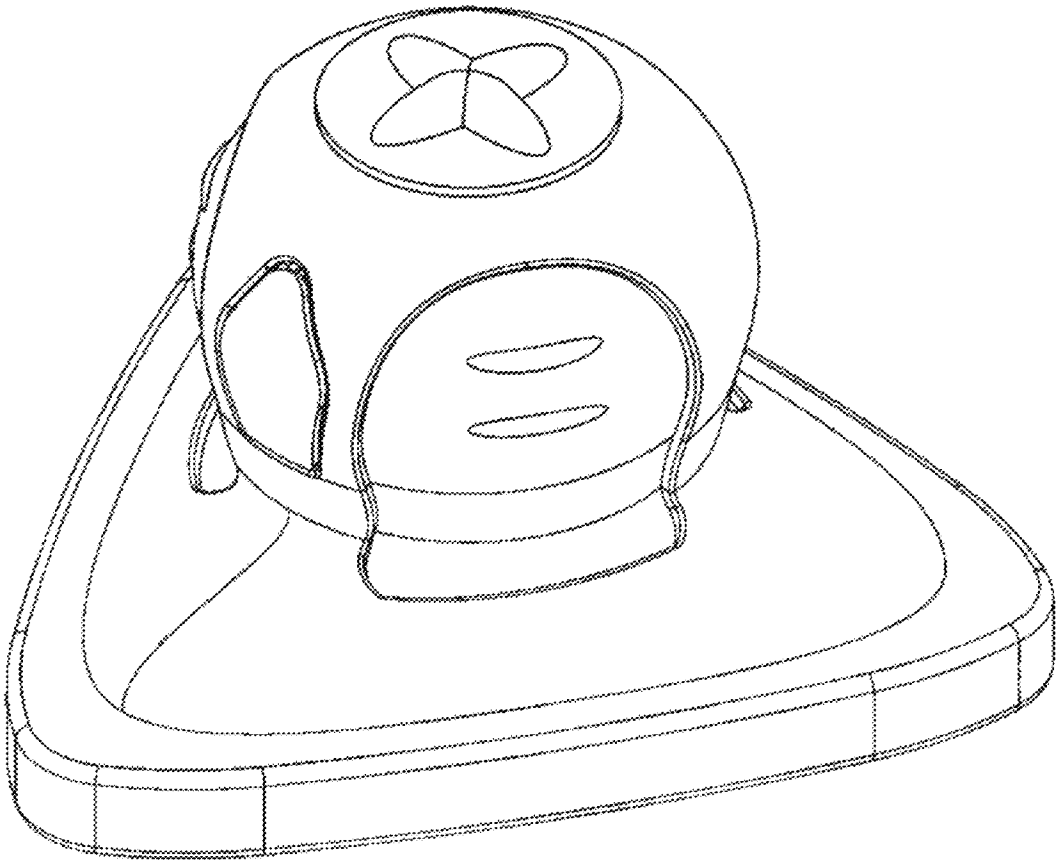
FIG. 15 is a perspective view of another apparatus 2300 representative of a hand operated cleaning apparatus in accordance with an embodiment of the present invention.
Figure 16:
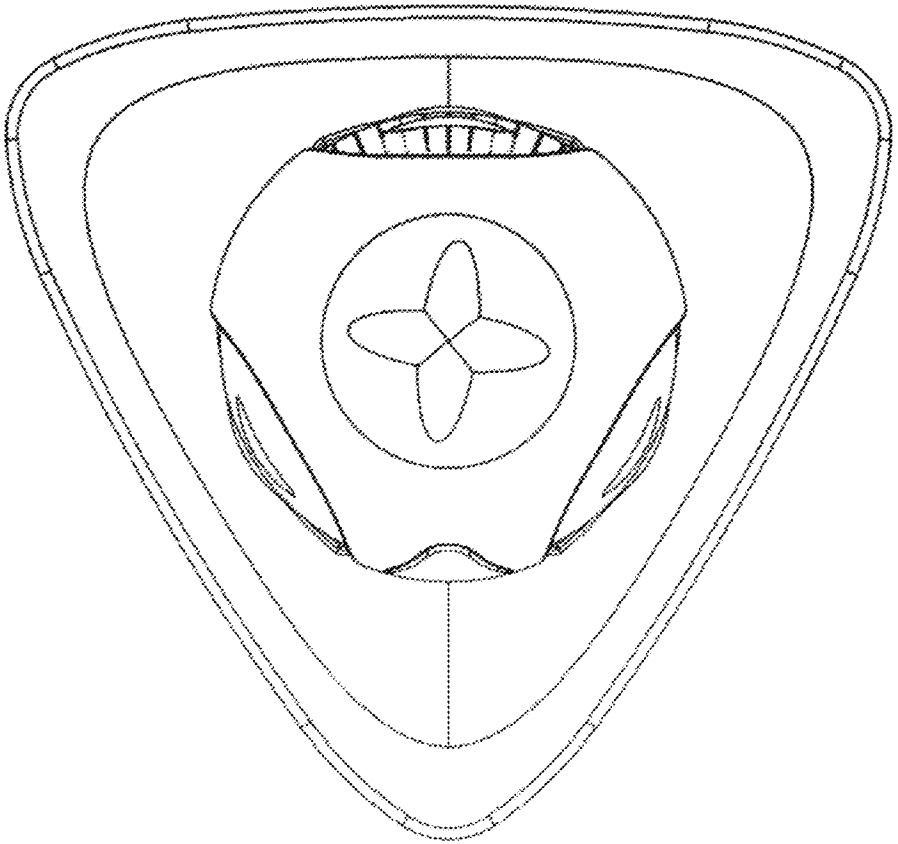
FIG. 16 is a top plan view of the apparatus 2300 of FIG. 15.
Figure 17:
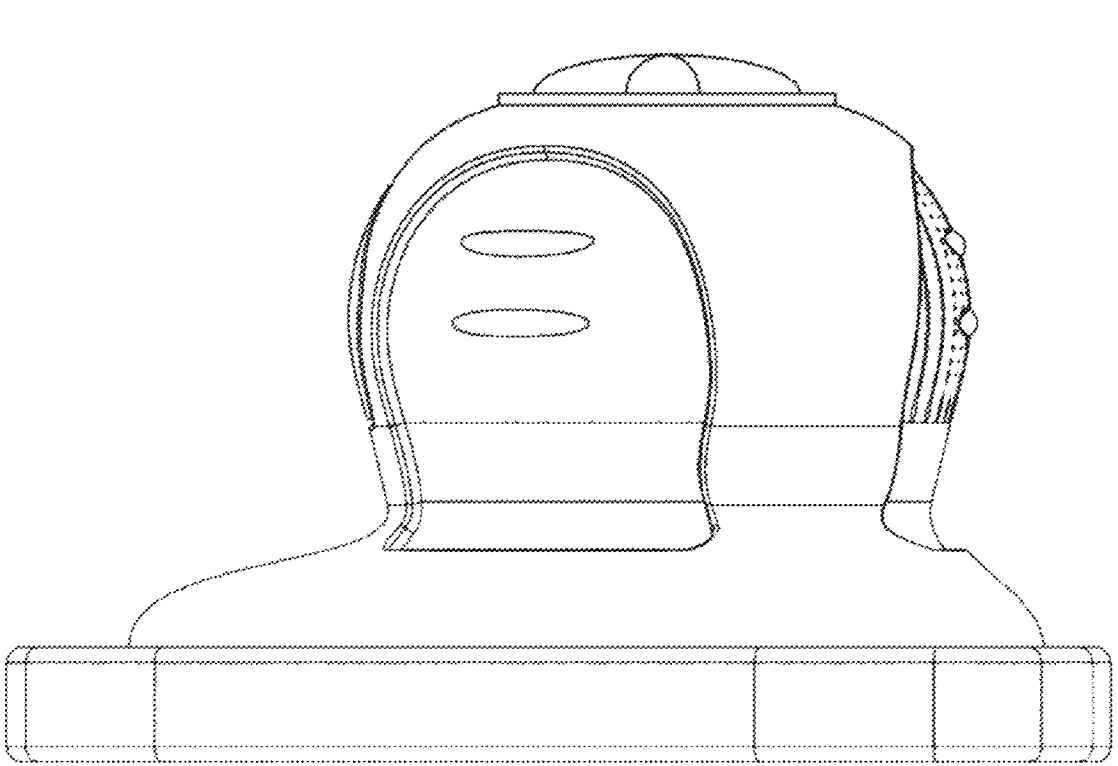
FIG. 17 is a side plan view of the apparatus 2300 of FIG. 15.
Figure 18:
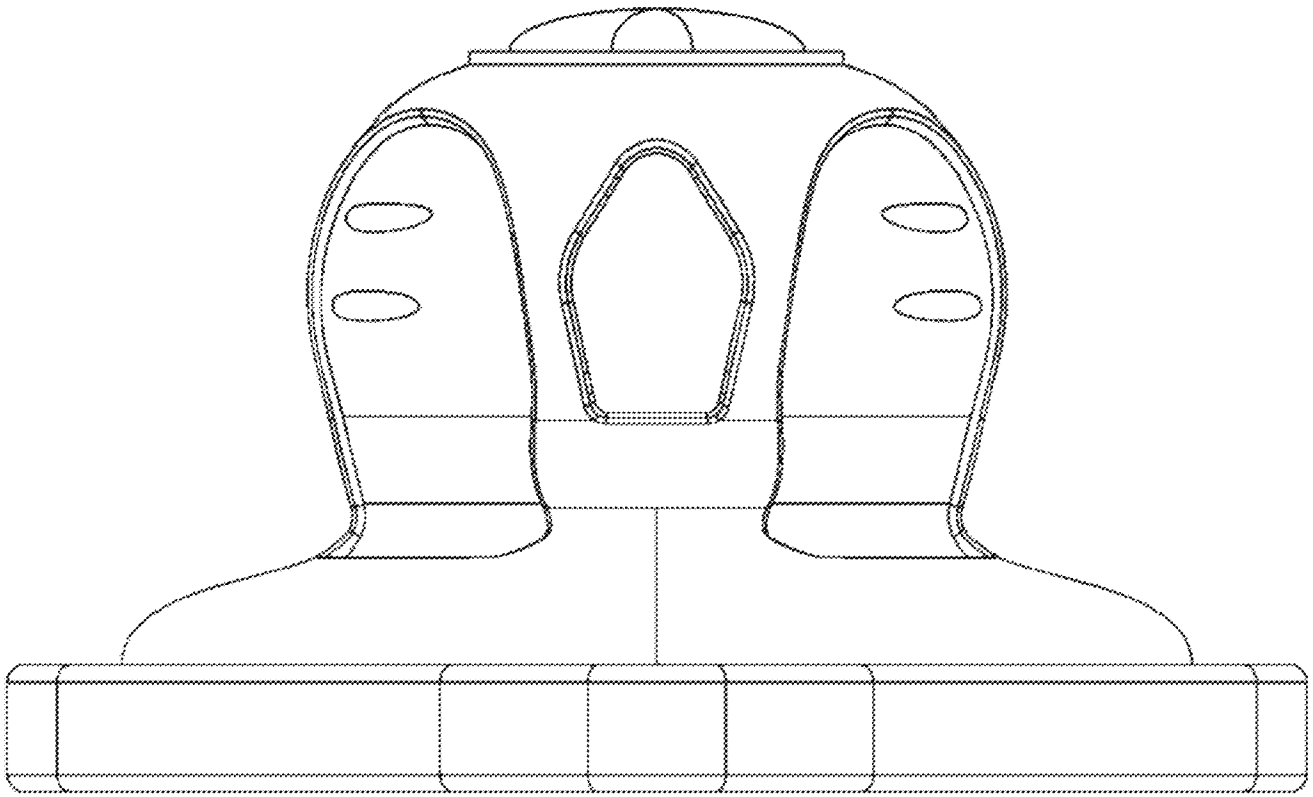
FIG. 18 is a front elevational view of the apparatus 2300 of FIG. 15.
Figure 19:
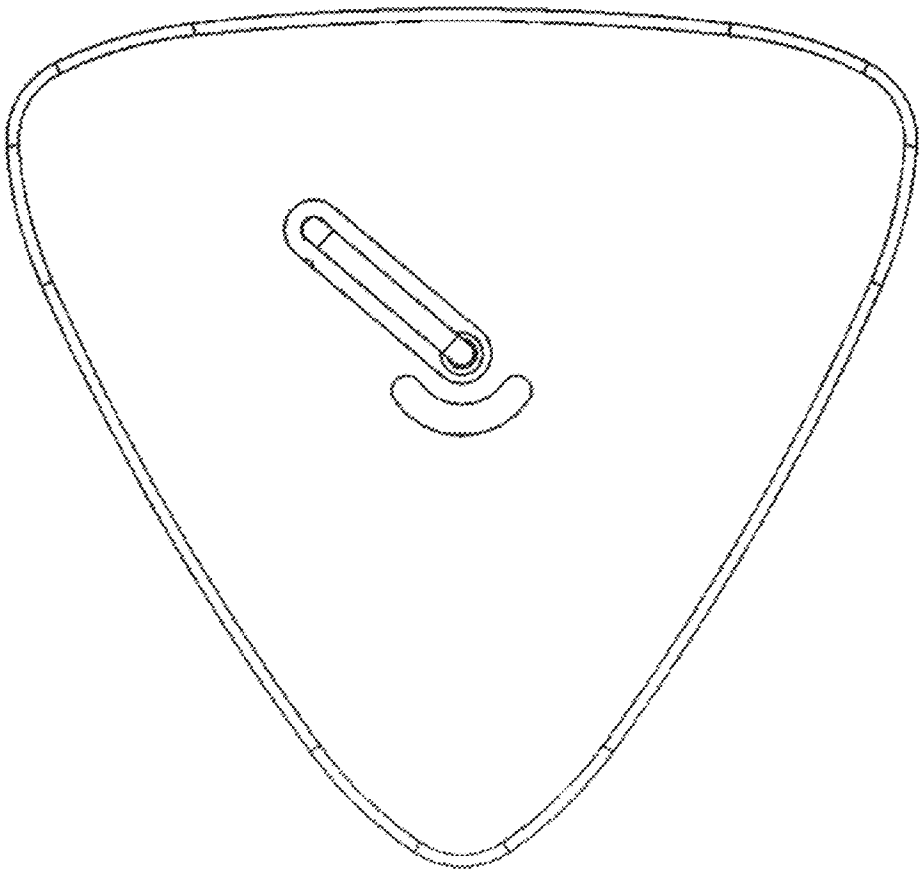
FIG. 19 is a bottom plan view of the apparatus 2300 of FIG. 15.

FIG. 15 herein is a perspective view of another apparatus 2300 representative of a hand operated cleaning apparatus in accordance with an embodiment of the present invention, and FIG. 23*a* of 2013/0306103 is a shaded perspective view of the apparatus 2300 similar to the view of FIG. 15 herein. Similarly, FIG. 16 herein is a top plan view of the apparatus 2300 of FIG. 15 herein, and FIG. 24*a* of 2013/0306103 is a shaded top plan view of the apparatus 2300 of FIG. 15 herein; FIG. 17 herein is a side plan view of the apparatus 2300 of FIG. 15 herein, and FIG. 25*a* of 2013/0306103 is a shaded side plan view of the apparatus 2300 of FIG. 15 herein; FIG. 18 herein is a front elevational view of the apparatus 2300 of FIG. 15, and FIG. 26*a* of 2013/0306103 is a shaded front elevational view of the apparatus 2300 of FIG. 15 herein; FIG. 19 herein is a bottom plan view of the apparatus 2300 of FIG. 15 herein, and FIG. 27*a* of 2013/0306103 is a shaded bottom plan view of the apparatus 2300 of FIG. 15 herein.

Finally, another preferred embodiment is shown in FIG. 28 of 2013/0306103 and illustrates a seal that is provided as well as a steam exhaust port. Velcro for attachment of a sponge also is shown in this figure. It will be appreciated that the exhaust tube is provided to relieve the pressure if the water boils in the reservoir included in this embodiment. The exhaust exits at the bottom of the apparatus and preferably exits into the cleaning element itself, e.g., the sponge. The seal extends between the chassis and the shell.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. A hand operated cleaning apparatus, comprising:

(a) a reservoir capable of retaining liquid having a top surface, a bottom surface, a side surface, a filling port located on at least one surface, a closure to seal the filling port, and a passageway leading from the water reservoir to a susceptor;

(b) a steam chamber having a top surface, a bottom surface and side surfaces to contain built up steam having at least one exhaust duct that releases and directs contained steam;

(c) a pump attached to the passageway configured to transfer water contained in the water reservoir to the surface of the susceptor;

(d) a cleaning element attached to the bottom surface of the steam chamber having a bottom surface capable of cleaning a surface;

(e) wherein the susceptor comprises a material with electrical properties capable of absorbing and storing electromagnetic energy thereafter converting electromagnetic energy into heat having at least one surface capable of releasing heat;

(f) wherein the at least one exhaust duct includes a passageway leading from the steam chamber to an area of the cleaning element;

(g) wherein the apparatus is shaped and configured for disposition in a microwave oven whereby the susceptor heats by absorbing electromagnetic energy produced by the microwave oven;

(h) wherein the pump is configured to spray a mist of water from the reservoir onto the susceptor which, after heating, generates steam within the steam chamber upon contact with the water mist; and (i) wherein the steam is discharged through the duct into the area of the cleaning element for facilitating cleaning using the cleaning element.

2. The hand operated cleaning apparatus of claim 1, wherein the susceptor comprises a plurality of separate pieces or pieces joined by a binder material.

3. The hand operated cleaning apparatus of claim 1, wherein the susceptor comprises a single piece.

4. The hand operated cleaning apparatus of claim 3, wherein the susceptor includes grooves cut in the surface to increase the surface area of the susceptor.

5. The hand operated cleaning apparatus of claim 3, wherein the susceptor is dome shaped to increase the surface area of the susceptor.

6. The hand operated cleaning apparatus of claim 1, wherein the susceptor defines the steam chamber, configured to generate steam within the steam chamber upon contact with the water mist.

7. The hand operated cleaning apparatus of claim 1, further comprising a user interface in the form of a handle for gripping during scrubbing with the cleaning element.

8. A hand operated cleaning apparatus, comprising:

(a) a reservoir capable of retaining liquid having a top surface, a bottom surface, a side surface, a filling port located on at least one surface, a closure to seal the filling port, and a passageway leading from the water reservoir to a conducting element adhered to a susceptor adapted to be heated and release heat through the conducting element;

(b) a steam chamber having a top surface, a bottom surface and side surfaces to contain built up steam having at least one exhaust duct that releases and directs contained steam;

(c) a pump attached to the passageway configured to transfer water contained in the water reservoir to the surface of the conducting element;

(d) a cleaning element attached to the bottom surface of the steam chamber having a bottom surface capable of cleaning a surface;

(e) a passageway leading from the steam chamber to an area of the cleaning element;

(f) wherein the apparatus is shaped and configured for disposition in a microwave oven;

(g) wherein the conducting element is configured to conduct heat from the susceptor sufficient for the conducting element to produce steam;

(h) wherein the pump is configured to spray a mist of water from the reservoir onto the conducting element which, after heating, generates steam within the steam chamber upon contact with the water mist; and (i) wherein the steam is discharged through the duct into the area of the cleaning element for facilitating cleaning using the cleaning element.

9. The hand operated cleaning apparatus of claim 8, wherein the conducting element comprises an aluminum heat sink.

10. The hand operated cleaning apparatus of claim 8, wherein the conducting element is adhered to the susceptor with thermal grease.

11. The hand operated cleaning apparatus of claim 8, wherein the susceptor comprises a plurality of separate pieces or pieces joined by a binder material.

12. The hand operated cleaning apparatus of claim 8, wherein the susceptor comprises a single piece.

13. The hand operated cleaning apparatus of claim 12, wherein the susceptor includes grooves cut in the surface to increase the surface area of the susceptor.

14. The hand operated cleaning apparatus of claim 12, wherein the susceptor is dome shaped to increase the surface area of the susceptor.

15. The hand operated cleaning apparatus of claim 8, wherein the susceptor defines the steam chamber, configured to generate steam within the steam chamber upon contact with the water mist.

16. The hand operated cleaning apparatus of claim 8, further comprising a user interface in the form of a handle for gripping during scrubbing with the cleaning element.

17. A hand operated cleaning apparatus, comprising:

(a) a reservoir capable of retaining liquid having a top surface, a bottom surface, a side surface, a filling port located on at least one surface, a closure to seal the filling port, and a passageway leading from the water reservoir to a dome-shaped susceptor comprised of a single piece;

(b) a steam chamber having a top surface, a bottom surface and side surfaces to contain built up steam having at least one exhaust duct that releases and directs contained steam;

(c) a pump attached to the passageway configured to transfer water contained in the water reservoir to the surface of the susceptor;

(d) a cleaning element attached to the bottom surface of the steam chamber having a bottom surface capable of cleaning a surface;

(e) wherein the susceptor comprises a material with electrical properties capable of absorbing and storing electromagnetic energy thereafter converting electromagnetic energy into heat having at least one surface capable of releasing heat;

(f) wherein the at least one exhaust duct includes a passageway leading from the steam chamber to an area of the cleaning element;

(g) wherein the apparatus is shaped and configured for disposition in a microwave oven whereby the susceptor heats by absorbing electromagnetic energy produced by the microwave oven;

(h) wherein the susceptor is configured to generate steam within the steam chamber upon contact with the water mist (i) wherein the pump is configured to spray a mist of water from the reservoir onto the susceptor which, after heating, generates steam within the steam chamber upon contact with the water mist; and (j) wherein the steam is discharged through the duct into the area of the cleaning element for facilitating cleaning using the cleaning element.

18. The hand operated cleaning apparatus of claim 17, further comprising a user interface in the form of a handle for gripping during scrubbing with the cleaning element.

* * * * *